US010467956B2

(12) United States Patent
Duan et al.

(10) Patent No.: US 10,467,956 B2
(45) Date of Patent: Nov. 5, 2019

(54) PIXEL DRIVING CIRCUIT FOR DRIVING AN ORGANIC LIGHT EMITTING DIODE TO EMIT LIGHT, PIXEL DRIVING METHOD, ARRAY SUBSTRATE AND DISPLAY DEVICE

(71) Applicant: BOE TECHNOLOGY GROUP CO., LTD., Beijing (CN)

(72) Inventors: Liye Duan, Beijing (CN); Lirong Wang, Beijing (CN); Chungchun Lee, Beijing (CN); Chiehhsing Chung, Beijing (CN); Junjie Lin, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 120 days.

(21) Appl. No.: 15/307,788

(22) PCT Filed: Oct. 23, 2015

(86) PCT No.: PCT/CN2015/092660
§ 371 (c)(1),
(2) Date: Oct. 28, 2016

(87) PCT Pub. No.: WO2016/192275
PCT Pub. Date: Dec. 8, 2016

(65) Prior Publication Data

US 2017/0256200 A1 Sep. 7, 2017

(30) Foreign Application Priority Data

Jun. 3, 2015 (CN) ..... 2015 1 0300877

(51) Int. Cl.
*G09G 3/3233* (2016.01)
*G09G 3/3258* (2016.01)

(52) U.S. Cl.
CPC ..... *G09G 3/3233* (2013.01); *G09G 3/3258* (2013.01); *G09G 2300/0426* (2013.01);
(Continued)

(58) Field of Classification Search
CPC ... G09G 2300/0426; G09G 2300/0819; G09G 2300/0861; G09G 2310/0251;
(Continued)

(56) References Cited

U.S. PATENT DOCUMENTS 7,256,758 B2 8/2007 Hu et al.
2004/0056828 A1 3/2004 Choi et al.
(Continued)

FOREIGN PATENT DOCUMENTS

CN 1510652 A 7/2004
CN 101075409 A 11/2007
(Continued)

OTHER PUBLICATIONS

Office Action in Chinese Application No. 201510300877.7 dated Aug. 17, 2017, with English translation.
(Continued)

*Primary Examiner* — Ram A Mistry
(74) *Attorney, Agent, or Firm* — Womble Bond Dickinson (US) LLP

(57) ABSTRACT

The present disclosure provides a pixel driving circuit, an array substrate and a display device. The pixel driving circuit comprises a charge storage unit, for receiving a power supply voltage signal; a driving unit, for generating a driving current that drives the OLED to emit light; a reset unit, for writing a voltage of an initial voltage signal into a second terminal of the charge storage unit in a reset phase; a data write unit, for writing a voltage of a data voltage signal and the threshold voltage of the driving unit into the second terminal of the charge storage unit in a data write phase; and a light emitting control unit, for controlling the power supply voltage signal to be written into the driving unit so as to generate the driving signal in a light emitting phase.

14 Claims, 7 Drawing Sheets

(52) U.S. Cl.
CPC ..... *G09G 2300/0819* (2013.01); *G09G 2300/0861* (2013.01); *G09G 2310/0251* (2013.01); *G09G 2310/0262* (2013.01); *G09G 2320/0214* (2013.01); *G09G 2320/0233* (2013.01); *G09G 2320/043* (2013.01); *G09G 2320/0626* (2013.01); *G09G 2330/023* (2013.01)

(58) Field of Classification Search
CPC ... G09G 2310/0262; G09G 2320/0214; G09G 2320/0233; G09G 2320/043; G09G 2320/0626; G09G 2330/023; G09G 3/3233; G09G 3/3258
See application file for complete search history.

(56) References Cited

U.S. PATENT DOCUMENTS

| | | | | |
|---|---|---|---|---|
| 2005/0285825 | A1* | 12/2005 | Eom ..... | G09G 3/3233 345/76 |
| 2006/0028409 | A1 | 2/2006 | Numao | |
| 2014/0118420 | A1 | 5/2014 | Ma | |
| 2015/0187270 | A1* | 7/2015 | Lee ..... | G09G 3/3233 345/76 |

FOREIGN PATENT DOCUMENTS

| | | | |
|---|---|---|---|
| CN | 101256732 | A | 9/2008 |
| CN | 101908316 | A | 12/2010 |
| CN | 102629447 | A | 8/2012 |
| CN | 102646386 | A | 8/2012 |
| CN | 102956185 | A | 3/2013 |
| CN | 202855264 | U | 4/2013 |
| CN | 103500556 | A | 1/2014 |
| CN | 104851392 | A | 8/2015 |
| EP | 2 372 685 | A1 | 10/2011 |
| JP | 2009086253 | A | 3/2009 |
| KR | 20110104708 | A | 9/2011 |

OTHER PUBLICATIONS

Office Action received for Chinese Patent Application No. 201510300877.7, dated Feb. 24, 2018, 10 pages (5 pages of English Translation and 5 pages of Office Action).
International Preliminary Report on Patentability received for PCT Patent Application No. PCT/CN2015/092660, dated Dec. 14, 2017, 14 pages (9 pages of English Translation and 5 pages of Original Document).
International Search Report and Written Opinion in PCT/CN2015/092660 dated Feb. 16, 2016, with English translation. 16 pages.
Office Action in Chinese Application No. 201510300877.7 dated Dec. 2, 2016, with English translation.14 pages.

* cited by examiner

PIXEL DRIVING CIRCUIT FOR DRIVING AN ORGANIC LIGHT EMITTING DIODE TO EMIT LIGHT, PIXEL DRIVING METHOD, ARRAY SUBSTRATE AND DISPLAY DEVICE

The present application is the U.S. national phase entry of PCT/CN2015/092660, with an international filing date of Oct. 23, 2015, which claims the benefit of Chinese Patent Application No. 201510300877.7, filed on Jun. 3, 2015, the entire disclosure of which is incorporated herein by reference.

TECHNICAL FIELD

The present disclosure relates to the field of semiconductor technology, particularly to a pixel driving circuit and method, an array substrate and a display device.

BACKGROUND

The active matrix organic light emitting diode (AMOLED) display technology is a display technology applied in televisions and mobile devices, which has broad application prospects in portable electronic devices that are sensitive to power consumption by right of its characteristics of low power consumption, low cost and large size.

The organic light emitting diode (OLED) in the AMOLED can emit light because it is driven by the driving current generated by thin film transistors (TFTs). However, the threshold voltage of the TFT might change over time, which results in the problem that with the same inputted voltage on the TFTs, the driving currents generated by the TFTs are inconsistent, so as to cause the brightness of respective OLEDs to be different and the brightness of the AMOLED consisting of a plurality of OLEDs to be non-uniform, thereby influencing the display effect of the whole image.

SUMMARY

Embodiments of the present disclosure provide a pixel driving circuit and method, an array substrate and a display device.

In an aspect, embodiments of the present disclosure provide a pixel driving circuit for driving an organic light emitting diode to emit light, comprising:

a charge storage unit, a first terminal of the charge storage unit receiving a power supply voltage signal;

a driving unit, a control terminal of the driving unit being connected with a second terminal of the charge storage unit, for generating a driving current that drives the organic light emitting diode to emit light when a voltage of the second terminal of the charge storage unit is greater than a threshold voltage of the driving unit;

a reset unit, connected with the second terminal of the charge storage unit, for writing a voltage of an initial voltage signal into the second terminal of the charge storage unit in a reset phase;

a data write unit, connected with the second terminal of the charge storage unit, for writing a voltage of a data voltage signal and the threshold voltage of the driving unit into the second terminal of the charge storage unit in a data write phase; and a light emitting control unit, connected with the driving unit, for controlling the power supply voltage signal to be written into the driving unit so as to generate the driving signal in a light emitting phase.

Specifically, the driving unit comprises a driving transistor. A control terminal of the driving transistor is connected with the second terminal of the charge storage unit. A first electrode of the driving transistor receives the power supply voltage signal through the light emitting control unit. A second electrode of the driving transistor is connected with the organic light emitting diode through the light emitting control unit.

Specifically, the reset unit comprises a first transistor. A control terminal of the first transistor receives a reset switch signal. A first electrode of the first transistor receives the initial voltage signal. A second electrode of the first transistor is connected with the second terminal of the charge storage unit.

Specifically, the data write unit comprises a second transistor and a third transistor. A control terminal of the second transistor and a control terminal of the third transistor both receive a first control signal. A first electrode of the second transistor is connected with the control terminal of the driving transistor. A second electrode of the second transistor is connected with the second electrode of the driving transistor. A first electrode of the third transistor receives the data voltage signal. A second electrode of the transistor is connected with the first electrode of the driving transistor.

Specifically, the light emitting control unit comprises a fourth transistor and a fifth transistor. A control terminal of the fourth transistor and a control terminal of the fifth transistor both receive a second control signal. A first electrode of the fourth transistor receives the power supply voltage signal. A second electrode of the fourth transistor is connected with the first electrode of the driving transistor. A first electrode of the fifth transistor is connected with the second electrode of the driving transistor. A second electrode of the fifth transistor is connected with the organic light emitting diode.

Optionally, the driving transistor, the first transistor, the second transistor, the third transistor, the fourth transistor and fifth transistor are all thin film transistors.

In a possible implementation of the present disclosure, the pixel driving unit further comprises:

a potential compensation unit, connected with the control terminal of the driving unit, for providing leakage compensation for the control terminal of the driving unit in the light emitting phase.

Optionally, the potential compensation unit comprises anti-leakage transistor. A control terminal of the anti-leakage transistor receives a third control signal. A first electrode of the anti-leakage transistor receives the power supply voltage signal. A second electrode of the anti-leakage transistor is connected with the control terminal of the driving transistor.

Optionally, the third control signal and the second control signal have the same phase.

Optionally, the initial voltage signal is a constant-level signal.

In another possible implementation of the present disclosure, the initial voltage signal and the second control signal have opposite phases.

In another aspect, embodiments of the present disclosure provide a pixel driving method, applied in the above pixel driving circuit, comprising:

in a reset phase, a reset switch signal turns on a reset unit, the reset unit writes a voltage of an initial voltage signal into a charge storage unit;

in a data write phase, a first control signal turns on a data write unit, the data write unit writes a voltage of a data voltage signal and a threshold voltage of a driving unit into the charge storage unit, the driving unit generates a driving current that drives an organic light emitting diode to emit light when the voltage written into the charge storage unit is greater than the threshold voltage of the driving unit; and in a light emitting phase, a second control signal turns on a light emitting control unit, the light emitting control unit controls the power supply voltage signal to be written into the driving unit so as to generate the driving current.

In a possible implementation of the present disclosure, the pixel driving method further comprises:

in the light emitting phase, a third control signal turns on the potential compensation unit, the potential compensation unit provides leakage compensation for a control terminal of the driving unit.

Optionally, the third control signal and the second control signal have the same phase.

Optionally, the initial voltage signal is a constant-level signal.

In another possible implementation of the present disclosure, the initial voltage signal and the second control signal have opposite phases.

In a yet further aspect, embodiments of the present disclosure provide an array substrate comprising any pixel driving circuit as described above.

In a yet further aspect, embodiments of the present disclosure provide a display device, comprising any array substrate as described above.

BRIEF DESCRIPTION OF THE DRAWINGS

In order to explain the technical solutions in embodiments of the present disclosure more clearly, the drawings to be used in the description of the embodiments will be introduced briefly next. Apparently, the drawings described below are only some embodiments of the present disclosure. The ordinary skilled person in the art, without doing any creative work, can also obtain other drawings based on these drawings.

DETAILED DESCRIPTION

In order to enable the objects, technical solutions and advantages of the present disclosure to be clearer, the implementations of the present disclosure will be described in more detail with reference to the drawings below.

Figure 1:
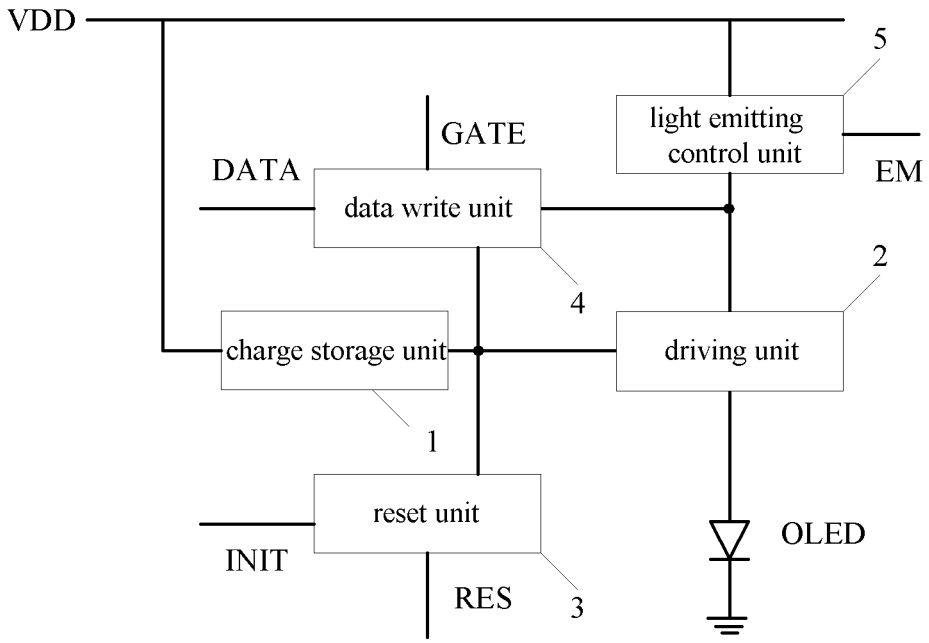
FIG. 1 is a structural schematic view of a pixel driving circuit provided by embodiments of the present disclosure.

Embodiments of the present disclosure provide a pixel driving circuit for driving an organic light emitting diode to emit light, see FIG. 1. The pixel driving circuit comprises:

a charge storage unit 1, a first terminal of the charge storage unit 1 receiving a power supply voltage signal;

a driving unit 2, a control terminal of the driving unit 2 being connected with a second terminal of the charge storage unit 1, for generating a driving current that drives the organic light emitting diode OLED to emit light when a voltage of the second terminal of the charge storage unit 1 is greater than a threshold voltage of the driving unit 2;

a reset unit 3, connected with the second terminal of the charge storage unit 1, for writing a voltage of an initial voltage signal INIT into the second terminal of the charge storage unit 1 in a reset phase;

a data write unit 4, connected with the second terminal of the charge storage unit 1, for writing a voltage of a data voltage signal DATA and the threshold voltage of the driving unit 2 into the second terminal of the charge storage unit 1 in a data write phase; and a light emitting control unit 5, connected with the driving unit 2, for controlling the power supply voltage signal to be written into the driving unit 2 so as to generate the driving signal in a light emitting phase.

The threshold voltage of the driving unit 2 is a voltage required for turning on the driving unit 2.

The control terminal of the reset unit 3 receives a reset switch signal RES. The reset switch signal RES controls whether the reset unit 3 is turned on. The control terminal of the data write unit 4 receives a first control signal GATE. The first control signal GATE is a scanning signal. The first control signal GATE controls whether the data write unit 4 is turned on. The control terminal of the light emitting control unit 5 receives a second control signal EM. The second control signal EM is a light emitting control signal. The second control signal EM controls whether the light emitting control unit 5 is turned on.

It can be understood that the data write unit 4 writes a voltage of the data voltage signal DATA and a threshold voltage of the driving unit 2 into the second terminal of the charge storage unit 1 in the data write phase. The driving unit 2 generates a driving current that drives the organic light emitting diode OLED to emit light when the voltage of the second terminal of the charge storage unit 1 is greater than the threshold voltage of the driving unit 2. Hence, in the light emitting phase, the threshold voltage contained in the voltage of the control terminal of the driving unit 2 counteracts the threshold voltage that is reduced due to the driving unit 2 being turned on. The driving current generated by the driving unit 2 is not affected by the threshold voltage of the driving unit 2. The driving current can be kept consistent. The brightness of each organic light emitting diode OLED is the same, and the display effect of the whole image is good.

Specifically, the charge storage unit 1 can be a capacitor.

Figure 2:
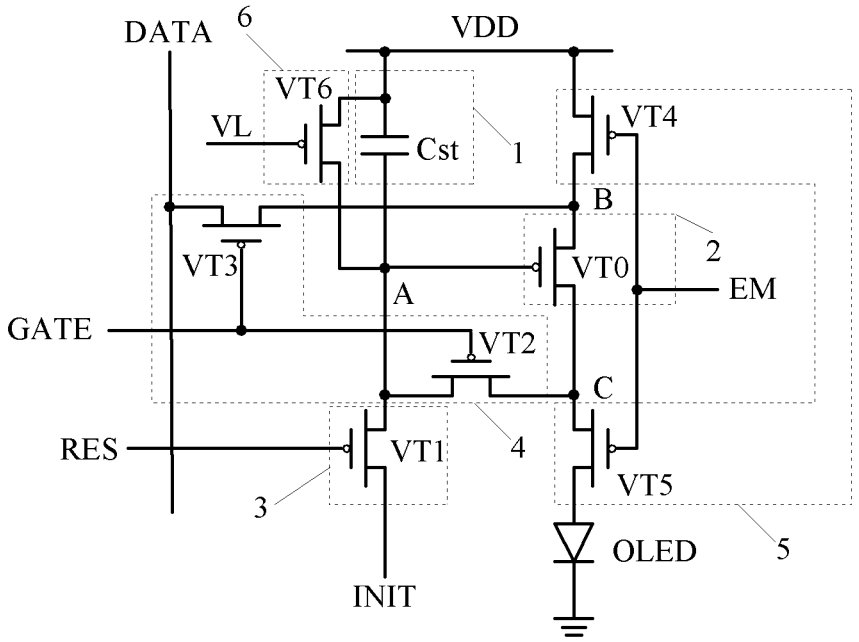
FIG. 2 is a structural schematic view of a specific implementation circuit of a pixel driving circuit provided by embodiments of the present disclosure.

More specifically, referring to FIG. 2, the charge storage unit 1 can comprise a storage capacitor Cst. The driving unit 2 can comprise a driving transistor VT0. The reset unit 3 can comprise a first transistor VT1. The data write unit 4 can comprise a second transistor VT2 and a third transistor VT3. The light emitting control unit 5 can comprise a fourth transistor VT4 and a fifth transistor VT5.

A first terminal of the storage capacitor Cst receives a power supply voltage signal VDD.

A gate of the driving transistor VT0 is connected with a second terminal of the storage capacitor Cst. A drain of the driving transistor VT0 is connected with the organic light emitting diode OLED through the light emitting control unit 5. A source of the driving transistor VT0 receives the power supply voltage signal VDD through the light emitting control unit 5.

A gate of the first transistor VT1 receives a reset switch signal RES. A second electrode of the first transistor VT1 is connected with the second terminal of the storage capacitor Cst. A first electrode of the first transistor VT1 receives the initial voltage signal INIT.

A gate of the second transistor VT2 and a gate of the third transistor VT3 both receive the first control signal GATE. A first electrode of the second transistor VT2 is connected with the gate of the driving transistor VT0. A second electrode of the second transistor VT2 is connected with the drain of the driving transistor VT0. A first electrode of the third transistor VT3 receives the data voltage signal DATA. A second electrode of the third transistor VT3 is connected with the source of the driving transistor VT0.

The gates of the fourth transistor VT4 and the fifth transistor VT5 both receive the second control signal EM. A first electrode and a second electrode of the fourth transistor VT4 are connected in series between the power supply voltage signal VDD and the source of the driving transistor VT0. A first electrode and a second electrode of the fifth transistor VT5 are connected in series between the drain of the driving transistor VT0 and the organic light emitting diode OLED. Specifically, the first electrode of the fourth transistor VT4 receives the power supply voltage signal VDD. The second electrode of the fourth transistor VT4 is connected with the first electrode of the driving transistor VT0. The first electrode of the fifth transistor VT5 is connected with the second electrode of the driving transistor VT0. The second electrode of the fifth transistor VT5 is connected with the organic light emitting diode OLED.

Further, the driving transistor VT0, the first transistor VT1, the second transistor VT2, the third transistor VT3, the fourth transistor VT4 and the fifth transistor VT5 can be all thin film transistors, which have a small volume, a low power consumption and can be controlled conveniently and accurately.

Optionally, the driving transistor VT0 can be a P-channel enhancement mode metal oxide semiconductor field effect transistor (MOSFET), and can also be a P-type bipolar junction transistor (BJT).

Optionally, the first to the fifth transistors VT1-VT5 can be one or more of the junction field effect transistors (JFET), enhancement mode MOSFETs, depletion mode MOSFETs and BJTs respectively.

Optionally, the first to the fifth transistors VT1-VT5 can be all P-type transistors, and can also be N-type transistors. When the first to the fifth transistors VT1-VT5 are P-type transistors, the first electrode is the source and the second electrode is the drain. When the first to the fifth transistors VT1-VT5 are N-type transistors, the first electrode is the drain and the second electrode is the source.

Figure 3:
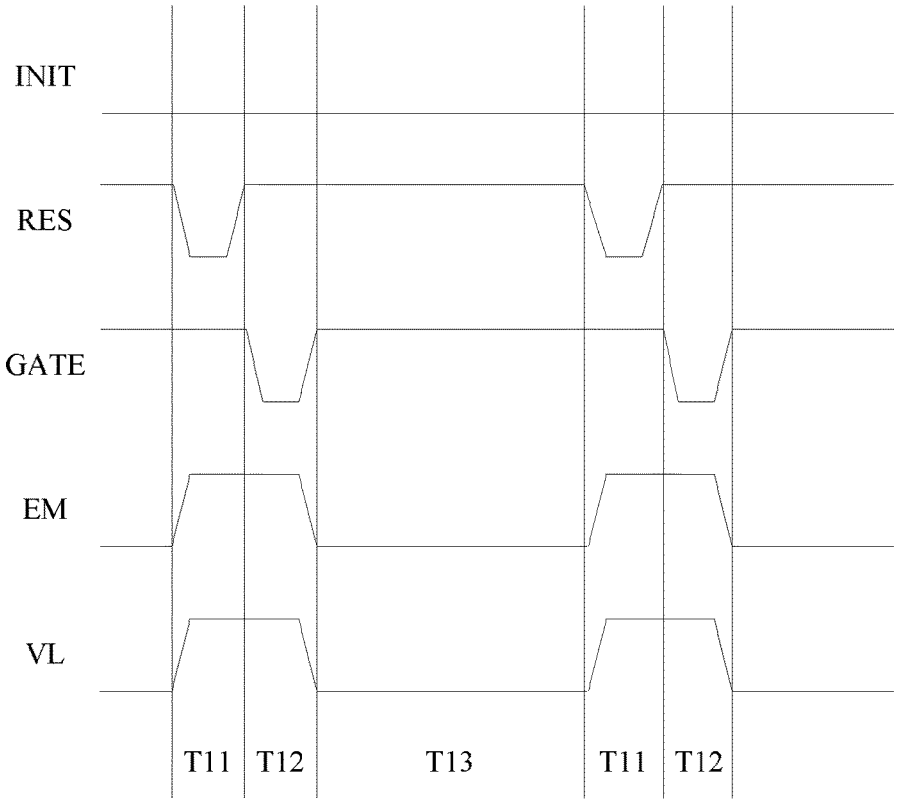
FIG. 3 is a timing diagram of a control signal of a pixel driving circuit provided by embodiments of the present disclosure.

FIG. 3 is a timing diagram of a control signal of a pixel driving circuit provided by embodiment of the present disclosure. It should be noted that the timing diagram as shown in FIG. 3 takes the example that the transistors are all P-type transistors; however, the present disclosure is not limited to this.

Figure 4:
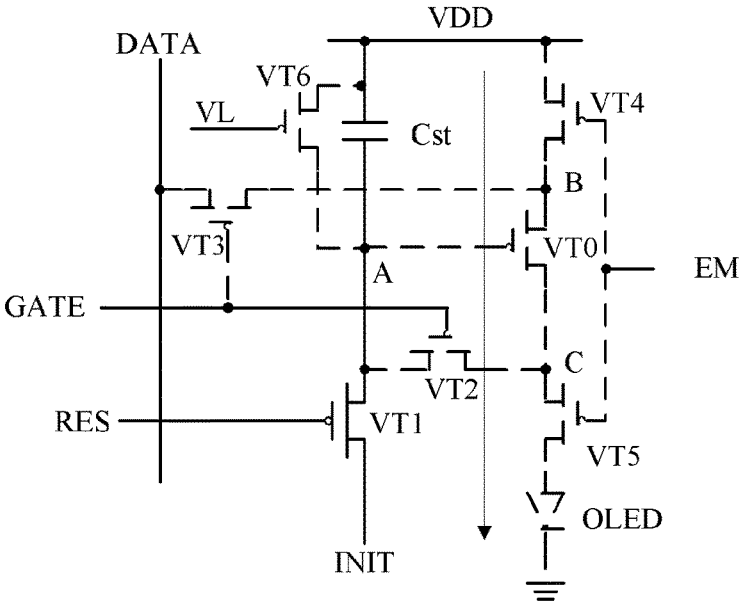
FIG. 4 is a schematic view of a current path in the reset phase provided by embodiments of the present disclosure.
Figure 5:
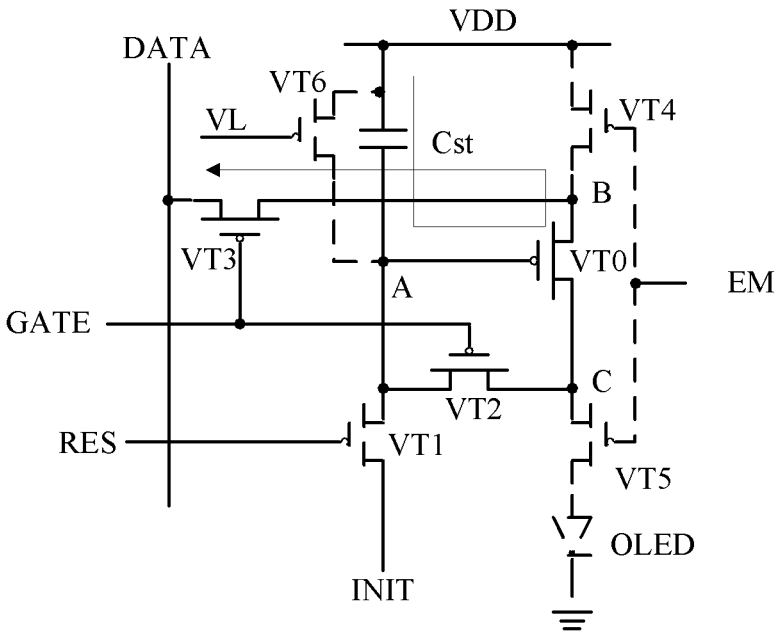
FIG. 5 is a schematic view of a current path in the data write phase provided by embodiments of the present disclosure.
Figure 6:
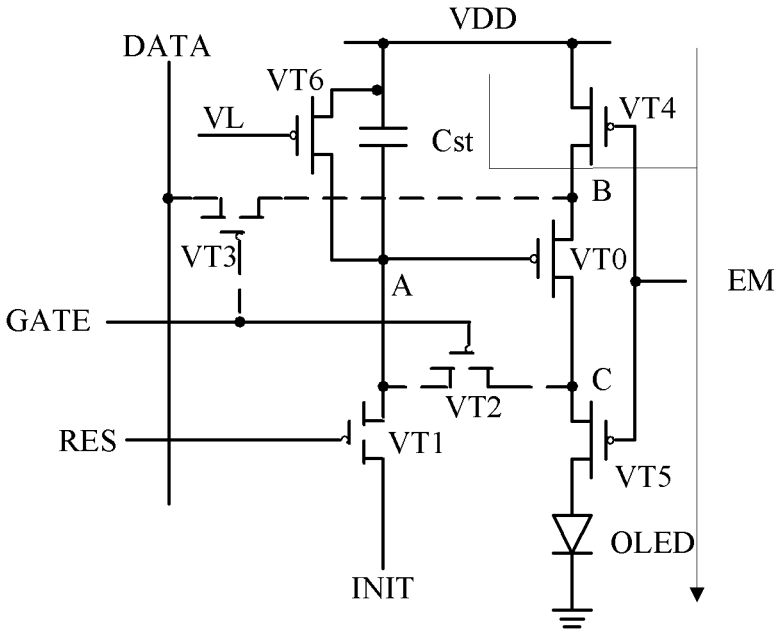
FIG. 6 is a schematic view of a current path in the light emitting phase provided by embodiments of the present disclosure.

As shown in FIG. 3, the timing of the control signal of the pixel driving circuit comprises three phases of a reset phase T11, a data write phase T12, and a light emitting phase T13. FIG. 4 is a schematic view of a current path of the reset phase. FIG. 5 is a schematic view of a current path of the data write phase. FIG. 6 is a schematic view of a current phase of the light emitting phase. For the convenience of illustration, in FIG. 4 to FIG. 6, the current paths of respective phases are marked out with arrows, the active components are marked out with real lines, and the inactive components are marked out with broken lines.

In the reset phase T11, referring to FIG. 3 and FIG. 4, the reset switch signal RES is of a low level. The first transistor VT1 controlled by the reset switch signal RES is turned on. The first terminal of the storage capacitor Cst inputs a power supply voltage signal VDD. The second terminal of the storage capacitor Cst inputs an initial voltage signal INIT. The storage capacitor Cst is charged because the voltage difference between the first terminal and the second terminal becomes large. The voltage of the initial voltage signal INIT is written into the second terminal of the storage capacitor Cst. Here, the potential of point A is consistent of the initial voltage signal INIT. The point A is a connecting point of the gate of the driving transistor VT0 and the second terminal of the storage capacitor Cst.

The first control signal GATE is of a high level. The second transistor VT2 and the third transistor VT3 controlled by the first control signal GATE are cut off. The second control signal EM and the third control signal VL are of a high level. The fourth transistor VT4 and the fifth transistor VT5 controlled by the second control signal EM, and the anti-leakage transistor VT6 controlled by the third control signal VL are cut off.

In the data write phase T12, referring to FIG. 3 and FIG. 5, the reset switch signal RES is of a high level. The first transistor VT1 controlled by the reset switch signal RES is cut off.

The first control signal GATE is of a low level. The second transistor VT2 and the third transistor VT3 controlled by the first control signal GATE are turned on. The second transistor VT2 is turned on. The gate and the drain of the driving transistor VT0 respectively connected with the first electrode and the second electrode of the second transistor VT2 are connected and short circuit. Only the PN junction between the gate and the source of the driving transistor VT0 is effective. The driving transistor VT0 is in the diode connecting mode. The third transistor VT3 is turned on. The data voltage signal DATA received by the first electrode of the third transistor VT3 is transmitted to the source of the driving transistor VT0 connected with the second electrode of the third transistor VT3. Here, the potential of point B is consistent with the data voltage signal DATA. The point B is the connecting point of the source of the driving transistor VT0. Because only the PN junction between the gate and the source of the driving transistor VT0 is effective, the potential of the point A here becomes VDATA+Vth. VDATA is the potential of the data voltage signal DATA. Vth is the threshold voltage of the PN junction. The storage capacitor Cst is discharged because the voltage difference between the first terminal and the second terminal becomes small.

The second control signal EM and the third control signal VL are still of a high level. The fourth transistor VT4 and the fifth transistor VT5 controlled by the second control signal EM, and the anti-leakage transistor VT6 controlled by the third control signal VL are still cut off.

In the light emitting phase T13, referring to FIG. 3 and FIG. 6, the reset switch signal RES and the first control signal GATE are of a high level. The first transistor VT1 controlled by the reset switch signal RES, the second transistor VT2 and the third transistor VT3 controlled by the first control signal GATE are cut off.

The second control signal EM is of a low level. The fourth transistor VT4 and the fifth transistor VT5 controlled by the second control signal EM are turned on. In addition, the potential of point A here is kept being VDATA+Vth, and the driving transistor VT0 is turned on and working in the saturation area, so the fourth transistor VT4, the driving transistor VT0, the fifth transistor VT5, and the organic light emitting diode OLED form a passage, and the driving transistor VT0 generates a driving current. Here, the potential of point C is VOLED. The point C is the connecting point of the drain of the driving transistor VT0. VOLED is the light emitting voltage of the organic light emitting diode OLED. The driving current Id=F(Vgs)=F (the driving transistor gate potential−the driving transistor source potential) =F (the driving transistor gate potential−(the driving transistor drain potential+the voltage difference between the source and the drain of the driving transistor))=F (potential of point A−(potential of point C+the voltage difference between the source and the drain of the driving transistor)) =F(VDATA+Vth−VOLED−Vth)=F(VDATA−VOLED), F(*) represents a function taking*as the variable, Vgs is the voltage between the gate and the source. From the formula Id=F(VDATA−VOLED) it can be seen that the size of the driving current is unrelated to the threshold voltage of the PN junction. The pixel driving circuit provided by embodiments of the present disclosure can compensate driving current deviation caused by shifts of the threshold voltage and generate consistent driving currents so as to ensure uniformity of the OLED brightness in the AMOLED.

Figure 7:
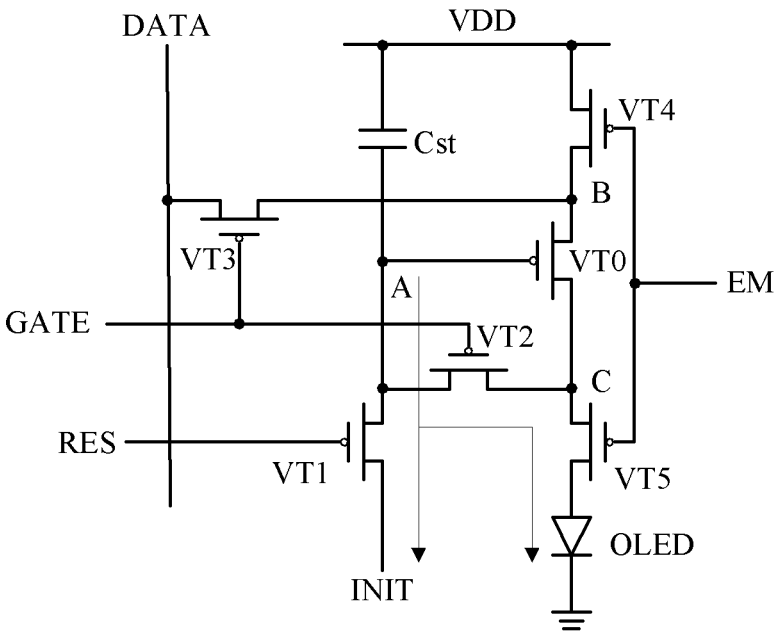
FIG. 7 is a structural schematic view of leakage generation provided by embodiments of the present disclosure.

It shall be noted that as shown in FIG. 7, in the light emitting phase, the charges stored in the storage capacitor Cst will be leaked through the first transistor VT1 and the second transistor VT2 (the leakage direction is as shown by the arrows in FIG. 7). The amount of charges stored by the storage capacitor Cst will be reduced. The potential of the second terminal of the storage capacitor Cst will be reduced. The potential of the gate of the driving transistor VT0 will be reduced. The voltage difference between the gate and the source of the driving transistor VT0 will be increased. The driving current generated by the driving transistor VT0 will be increased. The light emission of the OLED will be strengthened. It may result in the problem of failing to write correct display data when it is serious.

This embodiment can solve the above problem, as shown in FIG. 2, the pixel driving circuit may further comprise:

a potential compensation unit 6, connected with the control terminal of the driving unit 2, for providing leakage compensation for the control terminal of the driving unit 2 in the light emitting phase.

Specifically, the potential compensation unit 6 can comprise an anti-leakage transistor VT6. A gate of the anti-leakage transistor VT6 receives a third control signal VL. A first electrode of the anti-leakage transistor VT6 receives the power supply voltage signal VDD. A second electrode of the anti-leakage transistor VT6 is connected with the gate of the driving transistor VT0.

It can be understood that the anti-leakage transistor VT6 connects the power supply voltage signal VDD with the control terminal of the driving unit 2 in the light emitting phase, which effectively makes up and balances the potential of the control terminal of the driving unit 2 that is reduced due to leakage of the passage between the charge storage unit 1 and the driving unit 2, so that the potential of the control terminal of the driving unit 2 can keep consistent with the data voltage, so as to ensure correct write of data and normal light emission of the OLED. In addition, since the leakage is balanced, the charge storage unit 1 can select a capacitor with a relatively small capacity, so as to reduce the volume of the charge storage unit 1 (the volume of the capacitor is in direct proportion to the capacity), thereby reducing the area of the pixel effectively, so as to increase the number of pixels per unit area and improve image resolution of the whole panel.

Optionally, the anti-leakage transistor VT6 can be any one of the JFET, enhancement mode MOSFET, depletion mode MOSFET and BJT.

Optionally, the anti-leakage transistor VT6 can be a P-type transistor, and can also be an N-type transistor. When the anti-leakage transistor VT6 is a P-type transistor, the first electrode is the source and the second electrode is the drain. When the anti-leakage transistor VT6 is an N-type transistor, the first electrode is the drain and the second electrode is the source.

Optionally, as shown in FIG. 3, the third control signal VL can have the same phase as the second control signal EM.

It can be understood that the third control signal VL and the second control signal EM have the same waveform, and can be provided by the same signal line, which can be implemented without complex processes. On the one hand it saves cost, and on the other hand, it also reduces the design difficulty of the circuit.

Specifically, as shown in FIG. 3, the initial voltage signal INIT can be a constant-level signal.

In other implementations, the initial voltage signal INIT can also have an opposite phase to the second control signal EM.

It can be understood that in the light emitting phase, the second control signal EM is of a low level. The initial voltage signal INIT is of a high level (which has an opposite phase to the second control signal EM). A leakage current from the received initial voltage signal INIT to the gate of the driving transistor VT0 can be generated to balance and make up the leakage current consumed by the second transistor VT2. Meanwhile, the leakage current consumed from the gate of the driving transistor VT0 to the received initial voltage signal INIT is also restrained, which further improves the effect of keeping the potential of the gate of the driving transistor VT0 constant, and ensures correct write of data and normal light emission of the OLED. Moreover, the initial voltage signal INIT and the second control signal EM have opposite phases. The initial voltage signal INIT is obtained by reversing the phase of the second control signal EM, which can be implemented without complex processes. On the one hand, it saves cost, and on the other hand, it also reduces the design difficulty of the circuit.

Embodiments of the present disclosure writes the voltage of the data voltage signal and the threshold voltage of the driving unit into the second terminal of the charge storage unit through the data write unit in the data write phase, and generates a driving current that drives the organic light emitting diode to emit light when the voltage of the second terminal of the charge storage unit is greater than the threshold voltage of the driving unit. Therefore, in the light emitting phase, the threshold voltage contained in the voltage of the control terminal of the driving unit counteracts the threshold voltage that is reduced due to the driving unit being turning on. The driving current generated by the driving unit is not affected by the threshold voltage of the driving unit. The driving current can be kept consistent. The brightness of each organic light emitting diode is the same, and the display effect of the whole image is good.

Figure 8:
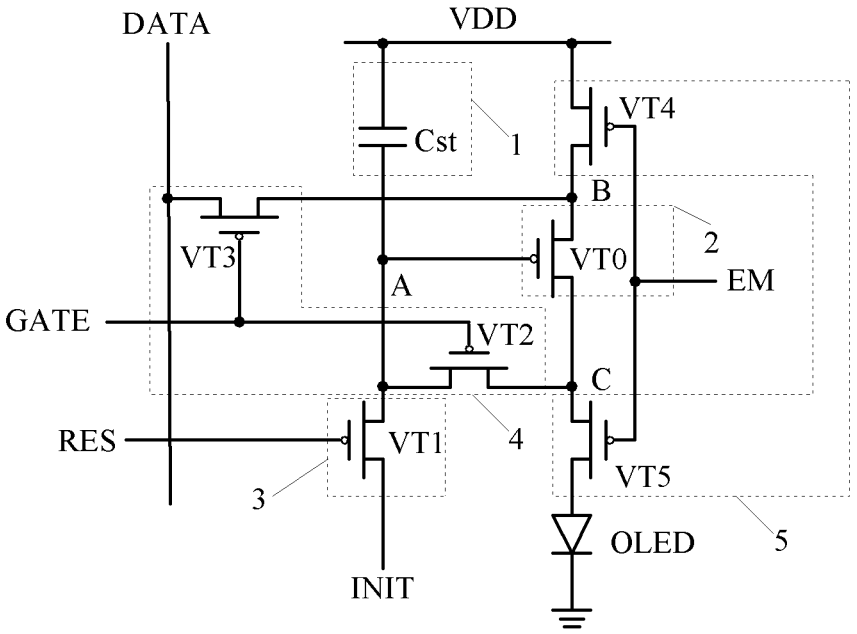
FIG. 8 is a structural schematic view of another specific implementation circuit of a pixel driving circuit provided by embodiments of the present disclosure.

Embodiments of the present disclosure provide another pixel driving circuit, which differs from the pixel driving circuit as shown in FIG. 2 in that, as shown in FIG. 8, the pixel driving circuit only requires that the initial voltage signal INIT and the second control signal EM have opposite phases (see FIG. 9 specifically) without having to arrange a potential compensation circuit.

Figure 9:
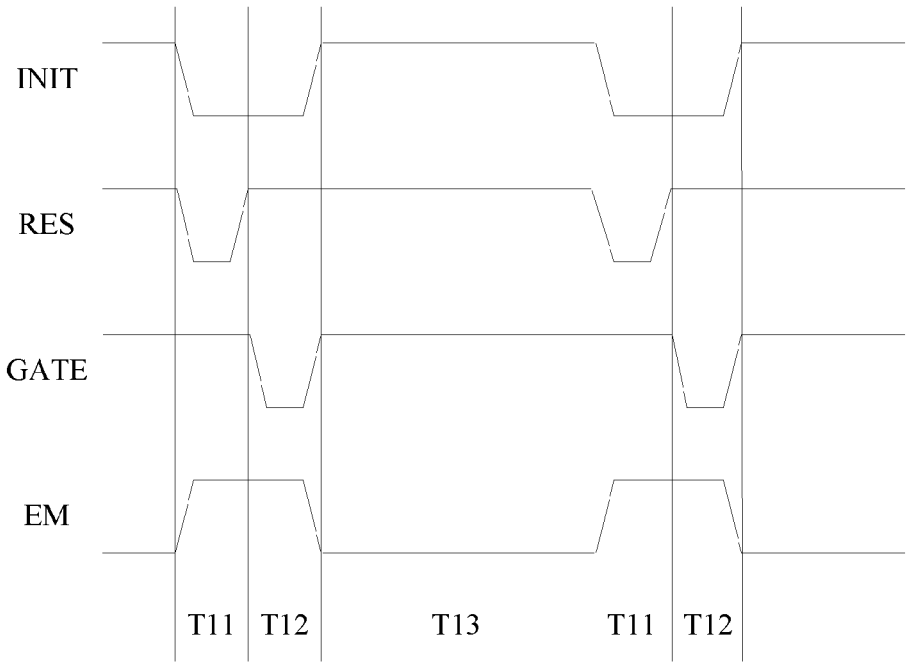
FIG. 9 is a timing diagram of another control signal of a pixel driving circuit provided by embodiments of the present disclosure.
Figure 10:
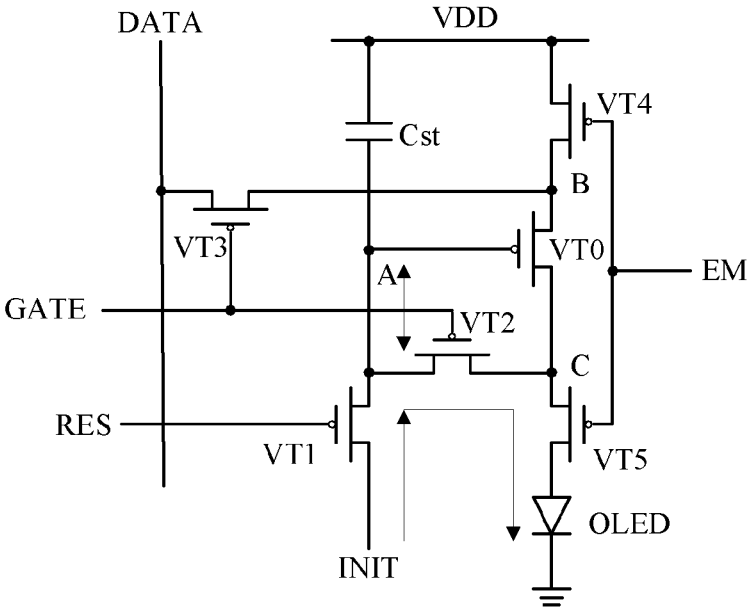
FIG. 10 is a structural schematic view of anti-leakage provided by embodiments of the present disclosure.

It can be understood that as shown in FIG. 9 (in FIG. 9, for example, the transistors are P-type transistors), the initial voltage signal INIT and the second control signal EM have opposite phases. The initial voltage signal INIT is of a high level in the light emitting phase. A leakage current from the received initial voltage signal INIT to the gate of the driving transistor VT0 is generated (the current direction is as shown by the arrows in FIG. 10), which balances and makes up the leakage current consumed by the second transistor VT2. Meanwhile, the leakage current consumed from the gate of the driving transistor VT0 to the received initial voltage signal INIT is also restrained, which keeps the potential of the gate of the driving transistor VT0 constant, and effectively makes up and balances the potential of the gate of the driving transistor VT0 that is reduced due to leakage of the passage between the storage capacitor Cst and the driving transistor VT0, so that the potential of the gate of the driving transistor VT0 can keep consistent with the data voltage, so as to ensure correct write of data and normal light emission of the OLED, and it does not need to add any component. In addition, since the leakage is balanced, the storage capacitor with a relatively small capacity can be selected, so as to reduce the volume of the storage capacitor (the volume of the storage capacitor is in direct proportion to the capacity), thereby reducing the area of the pixel effectively, so as to increase the number of pixels per unit area and improve image resolution of the whole panel. Further, the initial voltage signal INIT and the second control signal EM have opposite phases. The initial voltage signal INIT is obtained by reversing the phase of the second control signal EM, which can be implemented without complex processes. On the one hand, it saves cost, and on the other hand, it also reduces the design difficulty of the circuit.

Embodiments of the present disclosure writes the voltage of the data voltage signal and the threshold voltage of the driving unit into the second terminal of the charge storage unit through the data write unit in the data write phase, and generates a driving current that drives the organic light emitting diode to emit light when the voltage of the second terminal of the charge storage unit is greater than the threshold voltage of the driving unit. Therefore, in the light emitting phase, the threshold voltage contained in the voltage of the control terminal of the driving unit counteracts the threshold voltage that is reduced due to the driving unit being turning on. The driving current generated by the driving unit is not affected by the threshold voltage of the driving unit. The driving current can be kept consistent. The brightness of each organic light emitting diode is the same, and the display effect of the whole image is good.

Figure 11:
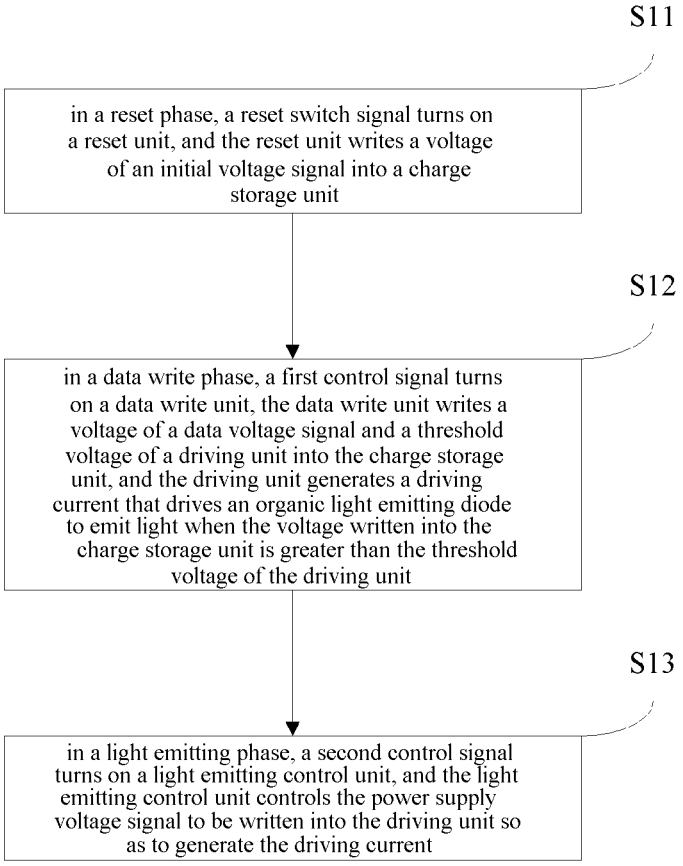
FIG. 11 is a flow chart of a pixel driving method provided by embodiments of the present disclosure.

Embodiments of the present disclosure provide a pixel driving method, applied in the above pixel driving circuit, referring to FIG. 11, comprising:

Step S11: in a reset phase, a reset switch signal turns on a reset unit, the reset unit writes a voltage of an initial voltage signal into a charge storage unit.

Specifically, combined with FIG. 2, in the reset phase, the reset switch signal RES controls the first transistor VT1 to be turned on, the first control signal GATE controls the second transistor VT2 and the third transistor VT3 to be cut off, and the second control signal EM controls the fourth transistor VT4 and the fifth transistor VT5 to be cut off.

Step S12: in a data write phase, a first control signal turns on a data write unit, the data write unit writes a voltage of a data voltage signal and a threshold voltage of a driving unit into the charge storage unit, and the driving unit generates a driving current that drives an organic light emitting diode to emit light when the voltage written into the charge storage unit is greater than the threshold voltage of the driving unit.

Specifically, combined with FIG. 2, in the data write phase, the reset switch signal RES controls the first transistor VT1 to be cut off, the first control signal GATE controls the second transistor VT2 and the third transistor VT3 to be turned on, and the second control signal EM controls the fourth transistor VT4 and the fifth transistor VT5 to be cut off.

Step S13: in a light emitting phase, a second control signal turns on a light emitting control unit, and the light emitting control unit controls the power supply voltage signal to be written into the driving unit so as to generate the driving current.

Specifically, combined with FIG. 2, in the light emitting phase, the reset switch signal RES controls the first transistor VT1 to be cut off, the first control signal GATE controls the second transistor VT2 and the third transistor VT3 to be cut off, and the second control signal EM controls the fourth transistor VT4 and the fifth transistor VT5 to be turned on.

In an implementation of this embodiment, the pixel driving method may further comprise:

in the light emitting phase, a third control signal turns on the potential compensation unit, and the potential compensation unit provides leakage compensation for a control terminal of the driving unit.

Specifically, combined with FIG. 2, in the light emitting phase, the third control signal VL controls the anti-leakage transistor VT6 to be turned on.

Optionally, the third control signal VL can have a same phase as the second control signal EM.

Optionally, the initial voltage signal INIT an also be a constant-level signal.

Optionally, the initial voltage signal INIT can have an opposite phase to the second control signal EM.

In another implementation of this embodiment, the initial voltage signal INIT can have an opposite phase to the second control signal EM.

Because the pixel driving method provided by embodiments of the present disclosure has corresponding technical features as any pixel driving circuit as described above, it can also solve the same technical problem and achieve the same technical effect.

Figure 12:
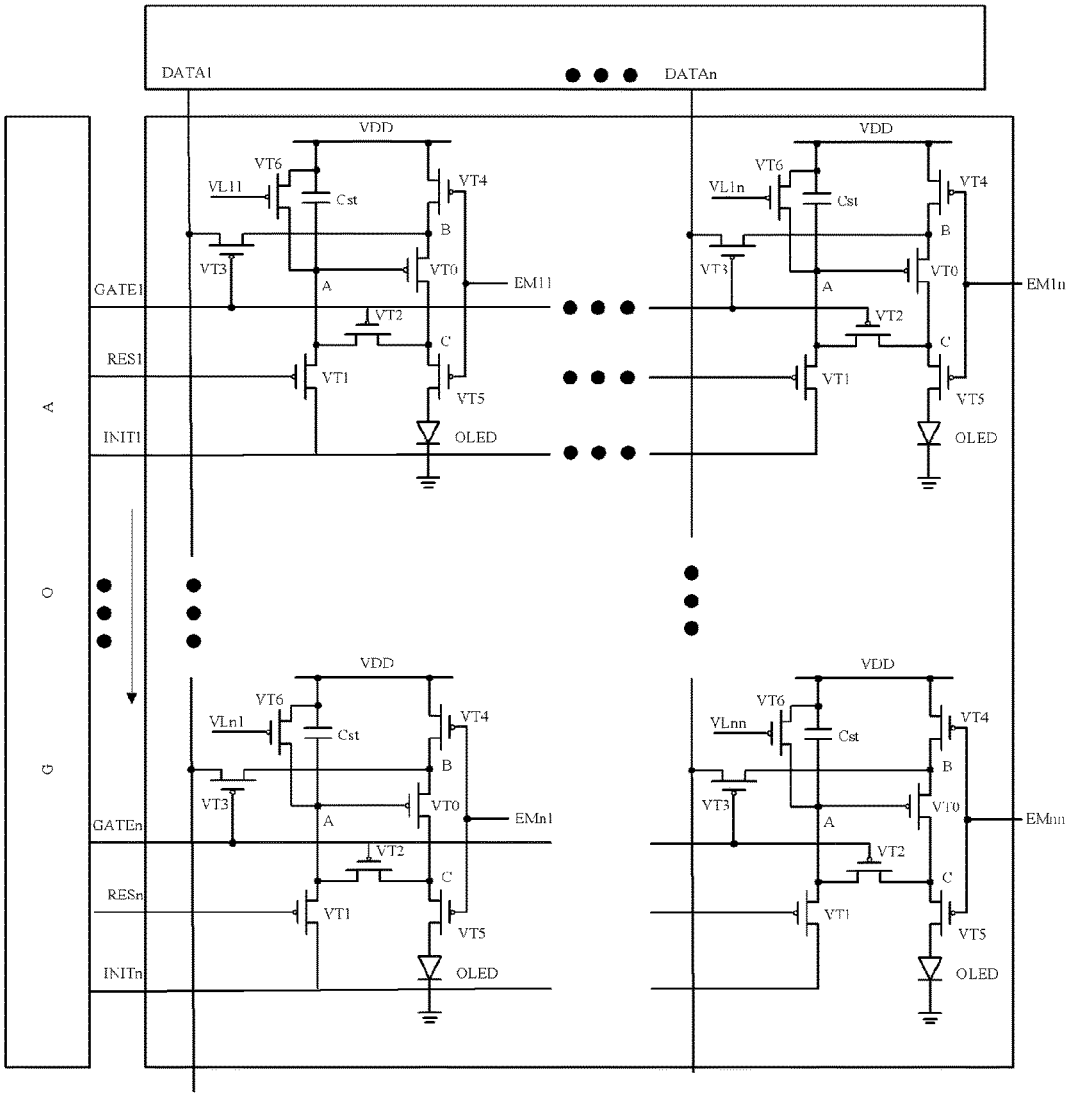
FIG. 12 is a structural schematic view of an array substrate provided by embodiments of the present disclosure.

Embodiments of the present disclosure provide an array substrate, referring to FIG. 12, the array substrate comprises any pixel driving circuit as described above.

It should be noted that FIG. 12 is an array substrate which takes a pixel driving circuit comprising the anti-leakage transistor VT6 as an example. In actual applications, the array substrate can also be constituted by a pixel driving circuit that does not comprise a potential compensation unit.

Because the array substrate provided by embodiments of the present disclosure has the same technical features as any pixel driving circuit as described above, it can also solve the same technical problem and achieve the same technical effect.

Embodiments of the present disclosure further provide a display device. The display device comprises any array substrate as described above. The display device can be any product or component with the display function such as electronic paper, an OLED panel, a mobile phone, a tablet computer, a television, a display, a laptop, a digital photo frame, a navigator etc.

Because the display device provided by embodiments of the present disclosure has the same technical features as any array substrate as above, it can also solve the same technical problem and achieve the same technical effect.

The ordinary skilled person in the art can understand that all or part of the steps for carrying out the above embodiments can be performed by hardware and can also be performed by programs instructing related hardware. The programs can be stored in a computer readable storage medium. The storage medium mentioned above can be a read-only memory, a magnetic disk or an optical disk etc.

What are stated above are only preferred embodiments of the present disclosure, which are not used for limiting the present disclosure. Any modifications, equivalent replacements, improvements and the like made within the spirit and the principle of the present disclosure should be encompassed within the protection scope of the present disclosure.

The invention claimed is:

1. A pixel driving circuit for driving an organic light emitting diode to emit light, comprising:

a charge storage unit, a first terminal of the charge storage unit receiving a power supply voltage signal;

a driving unit, a control terminal of the driving unit being connected with a second terminal of the charge storage unit, for generating a driving current that drives the organic light emitting diode to emit light when a voltage of the second terminal of the charge storage unit is greater than a threshold voltage of the driving unit;

a reset unit, connected with the second terminal of the charge storage unit, for writing a voltage of an initial voltage signal into the second terminal of the charge storage unit in a reset phase;

a data write unit, connected with the second terminal of the charge storage unit, for writing a voltage of a data voltage signal and the threshold voltage of the driving unit into the second terminal of the charge storage unit in a data write phase, wherein a control terminal of the data write unit receives a first control signal;

a light emitting control unit, connected with the driving unit, for controlling the power supply voltage signal to be written into the driving unit so as to generate the driving signal in a light emitting phase, wherein a control terminal of the light emitting control unit receives a second control signal; and a potential compensation unit, connected with the control terminal of the driving unit, for providing leakage compensation for the control terminal of the driving unit in the light emitting phase, wherein a control terminal of the potential compensation unit receives a third control signal, and the third control signal and the second control signal have the same phase.

2. The pixel driving circuit according to claim 1, wherein the driving unit comprises a driving transistor, a control terminal of the driving transistor is connected with the second terminal of the charge storage unit, a first electrode of the driving transistor receives the power supply voltage signal through the light emitting control unit, a second electrode of the driving transistor is connected with the organic light emitting diode through the light emitting control unit.

3. The pixel driving circuit according to claim 2, wherein the reset unit comprises a first transistor, a control terminal of the first transistor receives a reset switch signal, a first electrode of the first transistor receives the initial voltage signal, a second electrode of the first transistor is connected with the second terminal of the charge storage unit.

4. The pixel driving circuit according to claim 3, wherein the data write unit comprises a second transistor and a third transistor, a control terminal of the second transistor and a control terminal of the third transistor both receive the first control signal, a first electrode of the second transistor is connected with the control terminal of the driving transistor, a second electrode of the second transistor is connected with the second electrode of the driving transistor, a first electrode of the third transistor receives the data voltage signal, a second electrode of the transistor is connected with the first electrode of the driving transistor.

5. The pixel driving circuit according to claim 4, wherein the light emitting control unit comprises a fourth transistor and a fifth transistor, a control terminal of the fourth transistor and a control terminal of the fifth transistor both receive the second control signal, a first electrode of the fourth transistor receives the power supply voltage signal, a second electrode of the fourth transistor is connected with the first electrode of the driving transistor, a first electrode of the fifth transistor is connected with the second electrode of the driving transistor, a second electrode of the fifth transistor is connected with the organic light emitting diode.

6. The pixel driving circuit according to claim 5, wherein the driving transistor, the first transistor, the second transistor, the third transistor, the fourth transistor and fifth transistor are all thin film transistors.

7. The pixel driving circuit according to claim 5, wherein the initial voltage signal and the second control signal have opposite phases.

8. The pixel driving circuit according to claim 2, wherein the potential compensation unit comprises anti-leakage transistor, a control terminal of the anti-leakage transistor receives the third control signal, a first electrode of the anti-leakage transistor receives the power supply voltage signal, a second electrode of the anti-leakage transistor is connected with the control terminal of the driving transistor.

9. The pixel driving circuit according to claim 1, wherein the initial voltage signal is a constant-level signal.

10. An array substrate, comprising the pixel driving circuit according to claim 1.

11. A display device, comprising the array substrate according to claim 10.

12. A pixel driving method, applied in the pixel driving circuit according to claim 1, comprising:

in a reset phase, a reset switch signal turns on a reset unit, the reset unit writes a voltage of an initial voltage signal into a charge storage unit;

in a data write phase, a first control signal turns on a data write unit, the data write unit writes a voltage of a data voltage signal and a threshold voltage of a driving unit into the charge storage unit, the driving unit generates a driving current that drives an organic light emitting diode to emit light when the voltage written into the charge storage unit is greater than the threshold voltage of the driving unit; and in a light emitting phase, a second control signal turns on a light emitting control unit, the light emitting control unit controls the power supply voltage signal to be written into the driving unit so as to generate the driving current, and a third control signal turns on the potential compensation unit, the potential compensation unit provides leakage compensation for a control terminal of the driving unit, and the third control signal and the second control signal have the same phase.

13. The pixel driving method according to claim 12, wherein the initial voltage signal is a constant-level signal.

14. The pixel driving method according to claim 12, wherein the initial voltage signal and the second control signal have opposite phases.

* * * * *